US008336211B2

(12) United States Patent
De Wit et al.

(10) Patent No.: US 8,336,211 B2
(45) Date of Patent: Dec. 25, 2012

(54) SHAVING APPARATUS

(75) Inventors: Bastiaan Johannes De Wit, Drachten (NL); Fokke Roelof Voorhorst, Drachten (NL); Geert Veenstra, Drachten (NL); Leonardus Hendrikus Gerardus Johannes Segeren, Drachten (NL); Sieds Bosch, Drachten (NL); Sjoerd Haites, Drachten (NL)

(73) Assignee: Koninklijke Philips Electronics N.V, Eindhoven (NL)

( * ) Notice: Subject to any disclaimer, the term of this patent is extended or adjusted under 35 U.S.C. 154(b) by 320 days.

(21) Appl. No.: 11/630,451

(22) PCT Filed: Jun. 10, 2005

(86) PCT No.: PCT/IB2005/051917

§ 371 (c)(1),
(2), (4) Date: Dec. 19, 2006

(87) PCT Pub. No.: WO2006/000934

PCT Pub. Date: Jan. 5, 2006

(65) Prior Publication Data

US 2008/0276459 A1 Nov. 13, 2008

(30) Foreign Application Priority Data

Jun. 21, 2004 (EP) ..... 04102820

(51) Int. Cl.
*B26B 19/14* (2006.01)

(52) U.S. Cl. ..... 30/43.6; 30/43.4

(58) Field of Classification Search ..... 30/43.6, 30/43.4, 41.6

See application file for complete search history.

(56) References Cited

U.S. PATENT DOCUMENTS

| | | | | |
|---|---|---|---|---|
| 2,119,021 | A * | 5/1938 | Moskovies et al. | 30/41.5 |
| 4,222,168 | A | 9/1980 | Boiten et al. | |
| 4,318,223 | A * | 3/1982 | Bergsma et al. | 30/43.6 |
| 4,675,998 | A * | 6/1987 | Thijsse | 30/43.6 |
| 4,882,840 | A * | 11/1989 | Tietjens | 30/43.6 |
| 6,145,200 | A * | 11/2000 | Jorna et al. | 30/43.6 |
| 6,722,038 | B2 * | 4/2004 | Visman et al. | 30/43.6 |
| 2005/0257376 | A1 * | 11/2005 | De Wit et al. | 30/43.4 |

FOREIGN PATENT DOCUMENTS

| | | |
|---|---|---|
| EP | 0 179 515 | 4/1986 |
| EP | 0 487 537 | 7/1990 |
| WO | 9826190 A | 6/1998 |
| WO | WO-2004012914 * | 2/2004 |

* cited by examiner

*Primary Examiner* — Stephen Choi

(57) ABSTRACT

Shaving apparatus having at least one cutting unit with an external cutting member and a rotatable internal cutting member each the external and internal cutting members having cooperating cutting edges forming bearing surfaces of a first bearing, and a second bearing with bearing surfaces. To minimize the friction between the cutting edges, a support device having visco-elastic properties is provided between the two bearings. During operation, the distance between the bearing surfaces of the first bearing adjusts to the distance between the bearing surfaces of the second bearing. During cutting of hairs, the support device behaves as a stiff element whereas during periods in which no hairs are cut, the support device behaves relatively soft so that the cutting gaps between the cutting edges are closed.

7 Claims, 3 Drawing Sheets

SHAVING APPARATUS

Figure 1:
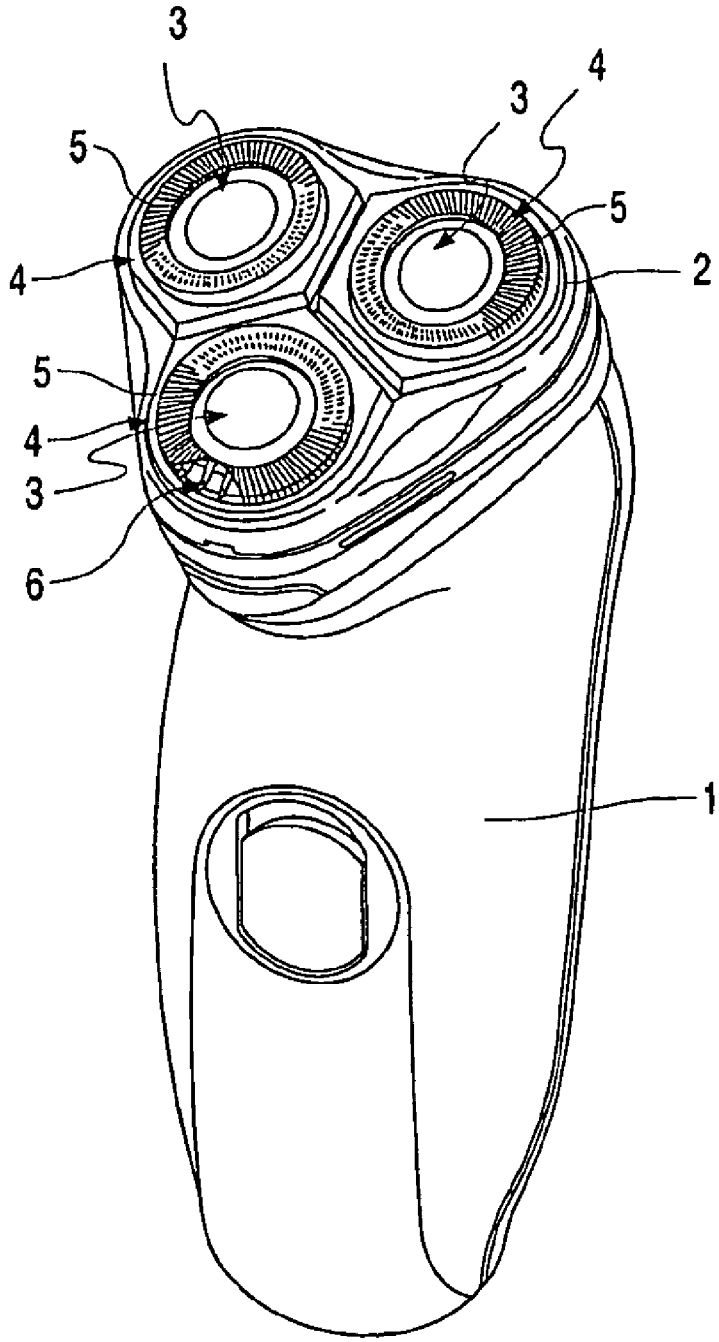

The invention relates to a shaving apparatus with a housing and at least one cutting unit that comprises an external cutting member and an internal cutting member that can be driven into rotation with respect to the former, said internal cutting member being provided with cutting elements having cutting edges, said external cutting member being provided with hair trap openings bounded by cutting edges for cooperating with the cutting edges of the cutting elements for the purpose of cutting hairs, and said cooperating cutting edges forming bearing surfaces of a first bearing between the external and the internal cutting member, which shaving apparatus further comprises a drive member for driving the internal cutting member, while a second bearing with cooperating bearing surfaces is present between the external and the internal cutting member.

The invention also relates to a cutting unit for use in the above shaving apparatus.

Such a shaving apparatus is known from EP 0179515 B1. The cooperating cutting edges of the internal and external cutting members in fact form the bearing surfaces of an axial bearing between the external and the internal cutting member. A so-termed cutting gap that is as small as possible should be present between the cooperating cutting edges so as to achieve a satisfactory cutting of hairs. This has been realized in practice until now in that the drive member for driving the internal cutting member is made resilient in the direction of the external cutting member. As a result, the internal cutting member bears on the external cutting member under a certain pre-stress, i.e. the cutting edges of the internal cutting member are pressed against the cutting edges of the external cutting member with a certain force. The cutting gap is thus effectively zero. This pre-stress is necessary because the internal cutting member is decelerated during cutting of a hair, and the occurring cutting forces have a direction such that the cooperating cutting edges tend to be pressed apart somewhat, which could give rise to too wide a cutting edge. The resilient force of the drive member prevents the gap between the cutting edges from becoming too great during cutting. As a result, the contact pressure between the internal and the external cutting member is small during severing of a hair, and the friction is accordingly low. Immediately after severing of a hair, however, the internal cutting member will be pressed back, and the cutting edges will lie against one another again under the pre-stress force.

Hairs are cut off during less than 10% of the total shaving time during a normal shaving operation. In the remaining time the cutting edges lie against one another under the pre-stress force. This causes a friction during a major portion of the time, which causes not only wear of the cutting edges, but also requires much energy. This means for rechargeable shaving apparatuses that the batteries have to be charged more often. Rechargeable batteries also have a finite life span, and the batteries will no longer be satisfactorily charged after a certain time and have to be replaced. A lower friction between the cutting members makes the apparatus more energy-efficient. To reduce this friction, EP 0179515 proposes to provide a second axial bearing between the external and the internal cutting member. It is achieved thereby that the major portion of the axial resilient force of the drive member is transmitted via the bearing surfaces of this second axial bearing to the external cutting member, which should make it possible to realize a minimum cutting gap, between the cooperating cutting edges. Since this second axial bearing has a very small radius to which the friction is applied, the result is a low frictional torque. The external cutting member and the internal cutting member form as it were a closed dynamic system via the bearings. In EP 0179515, this second axial bearing is a centrally located bearing which is at a distance from the first axial bearing formed by the cooperating cutting edges. The second axial bearing is constructed as a sphere here, which is additionally supported by a resilient element for accommodating dimensional tolerances. The fact that the reaction force exerted on the internal cutting member during cutting of a hair is absorbed on a smaller radius strongly reduces the frictional torque caused by the cooperating cutting edges. The frictional torque caused by the second bearing surface is so small that the sum of these two torques is much smaller than in a shaving system without this second axial bearing.

It is an object of the invention to have the cutting process proceed satisfactorily in a shaving apparatus and to reduce the frictional losses between the internal and the external cutting member still further.

The invention is for this purpose characterized in that means with visco-elastic properties are present between the first and the second bearing, whereby during operation of the shaving apparatus the distance between the bearing surfaces of the first bearing adapts itself to the distance between the bearing surfaces of the second bearing.

The means with visco-elastic properties have resilient as well as damping properties, i.e. the means behave rigidly in the short term and slackly in the longer term. This means that, when such a means is loaded under compression or tension for a very short period of time, it exhibits a comparatively rigid behavior, whereas it behaves comparatively slackly if the pressure is applied over a longer period of time. The cutting force occurring during cutting of a hair exerts a pressure on the cutting edge of the internal cutting member, which would tend to press the internal cutting member away from the external cutting member, which could lead to an undesirable cutting gap. The velocity of the cutting process suddenly strongly raises the pressure on the internal cutting member. The damping properties of the visco-elastic material ensure that the sudden pressure rise is absorbed by the material, which behaves rigidly then.

The force exerted on the internal cutting member during cutting of a hair is absorbed by the rigidly behaving material of the visco-elastic element. Nevertheless, a very small cutting gap arises between the cooperating cutting edges: the visco-elastic element is compressed slightly. After severing of the hair, the internal cutting member is pressed back towards the external cutting member owing to the resilient force of the visco-elastic element. In practice, however, another hair will be cut through before the cutting edges lie fully against one another again. As a result of this, the cutting gap will increase slightly in the course of a shaving operation (2 to 3 minutes), and even decrease slightly again towards the end of the shaving operation, because fewer hairs are cut off then.

As was described above, no hairs are cut during the major portion of the shaving time. Thanks to the means having visco-elastic properties between the first and the second bearing, the distance between the bearing surfaces formed by the cooperating cutting edges will adapt itself to the distance between the bearing surfaces of the second bearing. This has the result that the cooperating cutting edges make very little contact with one another not only during cutting of hairs, but also in the periods when no hairs are cut. The friction between the cooperating cutting edges is thus also very low. In addition, the bearing surfaces of the respective bearings adapt themselves mutually upon wear of the cutting edges. The means with visco-elastic properties may be formed by a single element with both resilient and damping properties. It is alternatively possible, however, for said means to comprise a number of elements, which all have both resilient and damping properties, or of which certain elements have only resilient and other elements only damping properties. The elements must be connected in parallel in the latter case.

A preferred embodiment of the shaving apparatus is characterized in that the internal cutting member comprises a rim of cutting elements and can be driven into rotation by means of a drive member that is resilient in axial direction and that bears on the internal cutting member in axial direction, and in that the means with visco-elastic properties are formed by a visco-elastic element that is centrally fastened on the internal cutting member and is provided with a bearing surface that bears in axial direction on the bearing surface of the external cutting member, said bearing surfaces constituting the second axial bearing. The resilient force exerted by the drive member on the internal cutting member must be somewhat greater than the resilient force of the visco-elastic element during the shaving operation so as to prevent the internal cutting member from getting detached from the external cutting member. The second bearing is relieved of its load during severing of hairs, so that this bearing can expand somewhat under the influence of its own resilience. Between the cutting operations of two hairs, the internal cutting member is pressed away from the external cutting member over a very small distance only as a result of this, i.e. a very small cutting gap arises which does indeed become slightly smaller during the periods when no hairs are cut, but which remains in existence, so that the friction between the cooperating cutting edges is very small.

The resilient effect of the drive member is partly or wholly compensated by the resilient/damping force of the visco-elastic element during the periods when no hairs are cut. Since this force is applied to a much smaller radius than before, it leads to a reduction in the frictional torque.

An alternative embodiment of the shaving apparatus is characterized in that the internal cutting member comprises a rim of cutting elements and can be driven into rotation by the drive member, and in that the internal cutting member is provided with a backing plate which is connected to the internal cutting member by means of a visco-elastic element having said visco-elastic properties, while the bearing surfaces of the second bearing are formed by a bearing surface of the backing plate and a bearing surface of the external cutting member.

The reaction force exerted on the internal cutting member during cutting of a hair is passed on to the external cutting member by the rigidly behaving visco-elastic element. The internal cutting member is pressed away from the external cutting member over a very small distance only, so that a very small cutting gap arises which does become slightly smaller during the periods when no hairs are cut, but which still remains in existence, so that the friction between the cooperating cutting edges, but also between the bearing surfaces of the second bearing, is very small. The cutting edges of the internal cutting member are pressed against the external cutting member by the resilient force of the visco-elastic element. This resilient force, however, is chosen to be small in this example. The major portion of the resilient force of the resilient means of the drive member is transmitted to the external cutting member via the second bearing.

A further, favorable embodiment of the shaving apparatus mentioned above is characterized in that the drive member is resilient in axial direction for exerting a force on the backing plate in the direction of the external cutting member, and in that the bearing surfaces of the second bearing are formed by a central bearing surface of the backing plate and a central bearing surface of the external cutting member. The second bearing constructed as a central bearing causes only a very weak frictional torque. The reaction force exerted on the internal cutting member during cutting of a hair is now transmitted to the resilient drive member by the visco-elastic element that behaves rigidly during cutting.

The invention further relates to a cutting unit comprising an external cutting member and an internal cutting member that can be driven into rotation with respect to the former, said internal cutting member being provided with cutting elements having cutting edges, said external cutting member being provided with hair trap openings bounded by cutting edges for cooperating with the cutting edges of the cutting elements for the purpose of cutting hairs, and said cooperating cutting edges forming bearing surfaces of a first bearing between the external and the internal cutting member, which cutting unit is characterized in that means with visco-elastic properties are present between the first and the second bearing.

Figure 2:
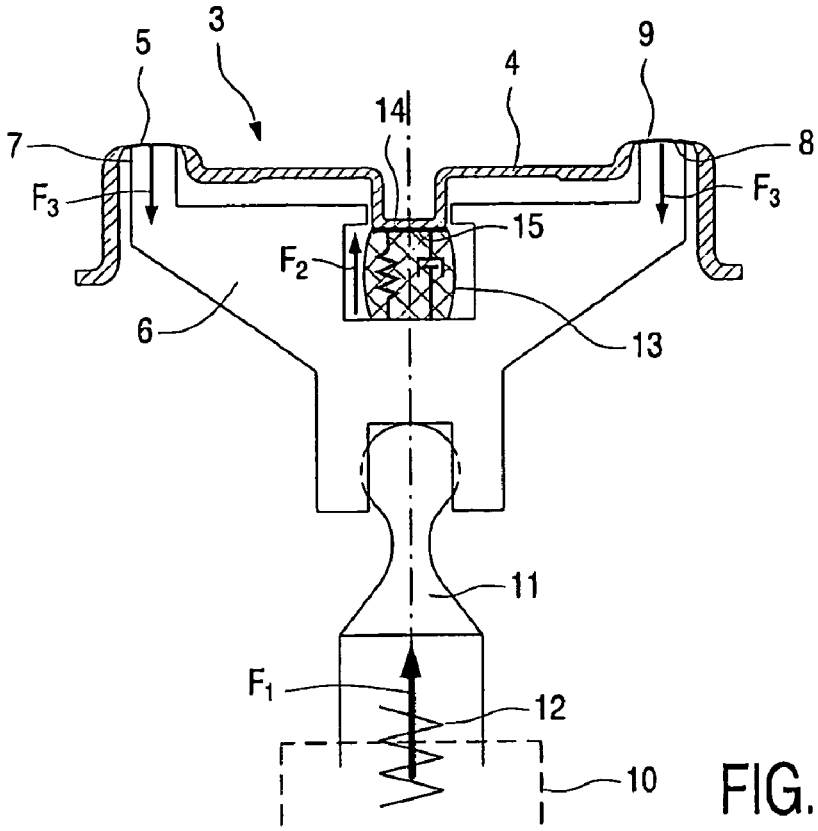
Figure 3:
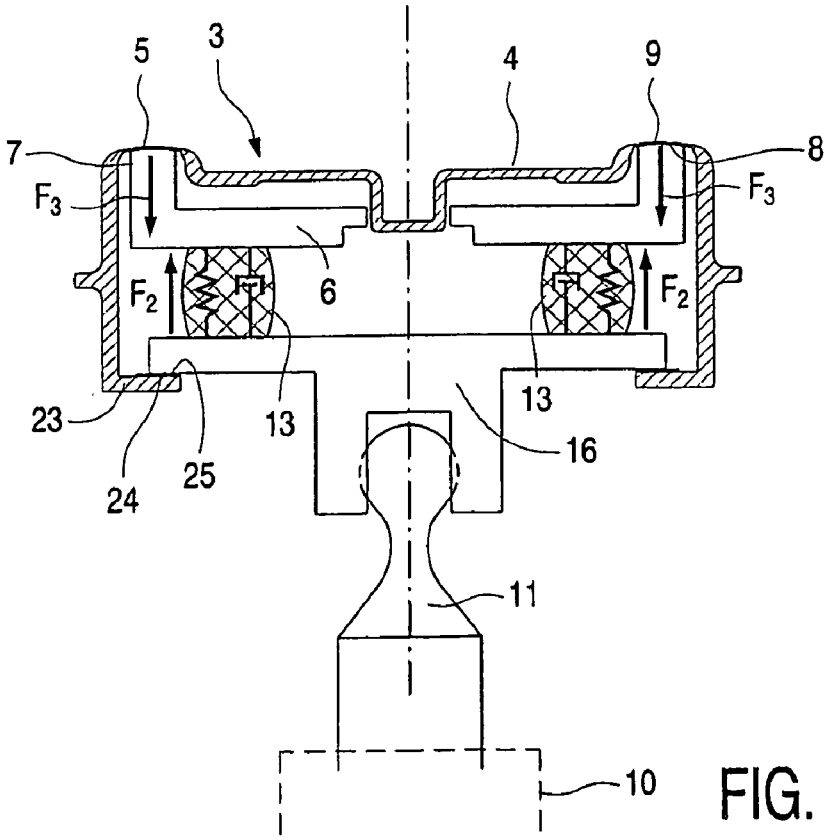
Figure 4:
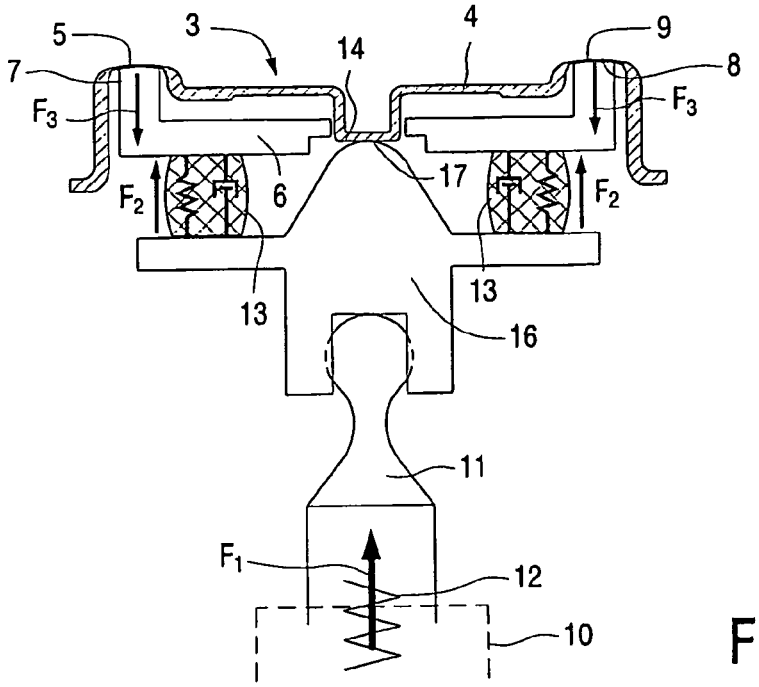
Figure 5:
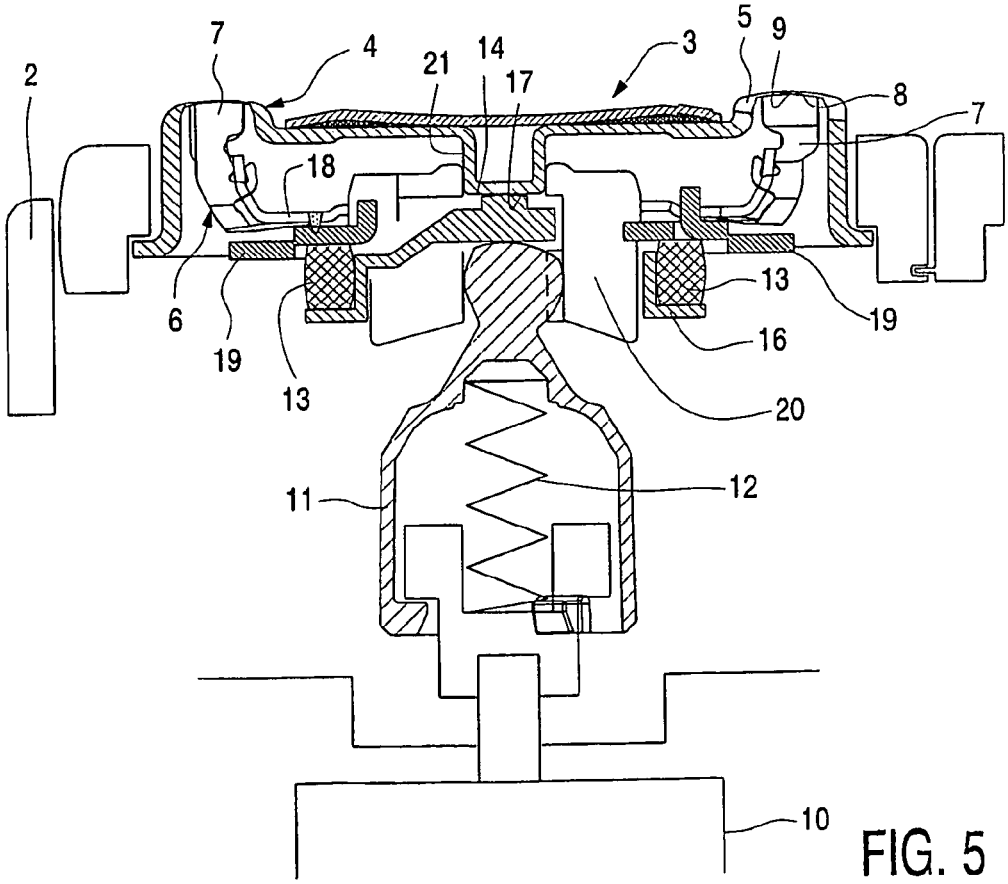

The invention will now be explained in more detail with reference to an embodiment shown in the drawing, in which:

FIG. 1 is a perspective view of a shaving apparatus with three cutting units, FIG. 2 diagrammatically shows a first embodiment of the invention, FIG. 3 diagrammatically shows a second embodiment of the invention, FIG. 4 diagrammatically shows a third embodiment of the invention, and FIG. 5 shows a practical realization of FIG. 4.

Corresponding components have been given the same reference numerals in the descriptions of the embodiments below.

FIG. 1 shows a rotary shaving apparatus with a housing 1 and a shaving head holder 2 which can be removed from the housing and/or can be pivoted with respect to the housing. Three cutting units 3, also denoted shaving heads, are present in the shaving head holder, each having an external cutting member 4 with hair trap openings 5 and an internal hair cutting member 6 that can be driven into rotation with respect to the former. The internal cutting members are driven by a motor (not shown) located in the housing of the shaving apparatus in a known manner.

FIG. 2 diagrammatically shows a first embodiment of the invention. The Figure shows one of the cutting units 3 formed by an external cutting member 4 and an internal cutting member 6 cooperating therewith. The external cutting member 4 has the shape of a circular cap with a rim of hair trap openings 5. The hair trap openings are bounded by walls which have cutting edges 9. The internal cutting member 6 has a number of cutting elements 7 whose ends are provided with cutting edges 8 for cooperating with the cutting edges 9 of the external cutting member 4. The cooperating cutting edges form a first bearing. The internal cutting member 6 is driven into rotation by a motor 10. For this purpose, the motor drives a drive member 11 which can be coupled to the internal cutting member 6. The drive member 11 is provided with a spring 12 which urges the internal cutting member 6 in the direction of the external cutting member 4 with a force $F_1$. A support element 13 of visco-elastic material is present between the internal cutting member 6 and the external cutting member 4. The support element has an axial bearing surface 15 which cooperates with a central bearing surface 14 of the external cutting member 4. The bearing surfaces 14 and 15 form the second bearing. The visco-elastic material has resilient as well as damping properties. This is symbolized in the Figure by a spring and a damper symbol in the support element.

Owing to its damping properties, said support element behaves as a rigid element when it is subjected to tension or compression during a short time period and as a slack element when the load is exerted during a longer period.

When the shaving apparatus is not operating, the spring 12 exerts a spring force $F_1$ in the direction of the internal cutting member 6. The support element 13 is slightly pressed in thereby owing to its resilient property. This is indicated by the arrow $F_2$. The dimensions are such that the forces $F_1$ and $F_2$ cause the cutting edges 8 of the internal cutting member 6 to bear on the cutting edges 9 of the external cutting member 4 with a small pre-stress of, for example, 0.1 N.

The cutting force causes a reaction force on the cutting edge 8 of the internal cutting member 6 during operation of the shaving apparatus at the moment when a hair is being cut. This reaction force has a vertical force component $F_3$. The reaction force arises in a very short time period, on average approximately 75 μs, depending on the cutting velocity. This period is shorter at a higher cutting velocity. The reaction force $F_3$ is absorbed by the resilient force $F_1$ of the spring 12. Nevertheless, a small cutting gap arises between the cutting edges 8 and 9 during this short period. The bearing surface 15 becomes detached from the bearing surface 14, so that the visco-elastic support element 13 can relax owing to its resilient properties. After severing of the hair, the spring 12 presses the bearing surface 14 towards the bearing surface 15 again. The cutting edges 8 and 9, however, do not make contact anymore: a very small cutting gap remains. This process repeats itself during cutting of consecutive hairs. The cutting gap will indeed increase slightly during the course of a shaving operation, but remains within the allowed tolerances for satisfactory cutting. It will be clear that the bearing surfaces 8 and 9 of the first bearing formed by the cutting edges will adapt to the bearing surfaces 14 and 15 of the second bearing during a shaving operation owing to the visco-elastic element. The major advantage is that the cutting edges 8 and 9 hardly make contact with one another throughout the entire shaving operation, so that friction, wear, and heat generation will be very small.

Some time after a shaving operation, the cutting edges will again lie entirely against one another, so that the shaving apparatus will function optimally during the next shaving operation. This may take place as soon as after approximately 10 seconds, which is desirable in the case of a washable shaving apparatus. The shaving head holder 2 with the cutting unit 3 is removed from the housing or hinged off the housing in such a shaving apparatus in order to be rinsed clean. The shaving apparatus is laid aside without the shaving head holder being mounted back onto the housing so as to allow the shaving apparatus to dry thoroughly. Since the spring force $F_1$ does not act on the internal cutting member during this period, a too wide cutting gap will arise between the cutting edges owing to the resilient property of the visco-elastic material. The shaving head holder is not put in place again until shortly before the next shaving operation. Only then can the spring 12 of the drive member 11 press the cutting edges against one another. A desirable time period for this is at most 10 seconds, but longer times are also practicable.

FIG. 3 diagrammatically shows a second embodiment of the invention. The internal cutting member 6 is provided with a backing plate 16 which is driven into rotation by the drive member 11. The drive member in this example does not exert a resilient pressure on the internal cutting member. The visco-elastic support element 13 is annular in shape and is located between the internal cutting member and the backing plate 16, and is connected to the latter. The internal cutting member 6, the visco-elastic support element 13, and the backing plate 16 form a single component that is enclosed in the external cutting member 4. For this purpose, the external cutting member is provided with a flange 23 directed to the interior with an axial bearing surface 24. The outermost edge portion of the backing plate 16 is provided with an axial bearing surface 25 for cooperating with the bearing surface 24 of the external cutting member 4. The bearing surfaces 24 and 25 form the second bearing. The support element should be dimensioned such that, when the shaving apparatus is not in use, the cutting edges 8 of the internal cutting member 6 bear with a slight pressure on the cutting edges 9 of the external cutting member 4. This pressure is caused by the resilient force $F_2$ of the visco-elastic support element 13, which ensures that the cooperating cutting edges lie against one another with a small pre-stress force of, for example, 0.1 N. The cutting force causes a reaction force on the cutting edge 8 of the internal cutting member 6 during operation of the shaving apparatus at the moment when a hair is being cut. This reaction force has a vertical force component $F_3$. The reaction force $F_3$ is absorbed by the rigidly behaving visco-elastic support element 13 and is transmitted to the external cutting member 4 via the bearing surfaces 25, 24. Nevertheless, a small cutting gap arises between the cutting edges 8 and 9 in said short time period. After severing of a hair, the visco-elastic element 13 presses the internal cutting member 6 back slightly towards the external cutting member 4, so that the cutting edges 8 and 9 come closer together again, i.e. the cutting gap becomes somewhat smaller, but will not become zero before the next hair is cut. In this example, again, the cutting edges 8 and 9 will hardly come into contact with one another during the entire shaving operation, so that the friction will be very small The third embodiment shown in FIG. 4 is a modification of the embodiment of FIG. 3. The internal cutting member 6 is provided with a backing plate 16 that is driven into rotation by the drive member 11. The backing plate 16 is provided with a central axial bearing surface 17 for cooperating with the central bearing surface 14 of the external cutting member 4. The bearing surfaces 14 and 17 form the second bearing. The spring 12 of the drive member 11 presses the backing plate 16 towards the external cutting member 7 with a force $F_1$. As in the example of FIG. 3, the dimensioning and material choice of the visco-elastic support element 13, and thus the internal resilient force $F_2$ and the choice and value of the resilient force $F_1$, will be such that the cutting edges 8 of the internal cutting member 6 bear on the cutting edges 9 of the external cutting member 4 with a slight pressure when the shaving apparatus is not operating. The operation of the shaving apparatus is practically the same as that described for the example of FIG. 3, with the difference that the reaction force $F_3$ is now transmitted to the spring 12 of the drive member 11. The creation of the slight cutting gap, and thus the low friction between the cutting edges 8 and 9, takes place in the same manner in this example as in the example of FIG. 3. In this example, however, the bearing surface 17 always remains in contact with the bearing surface 14, and the internal cutting member 6 is pressed back towards the external cutting member 4 by the visco-elastic element 13 after severing of a hair. Here, again, a small cutting gap remains, so that the friction in the first bearing is very low, and thus also the total frictional torque is very small. Another property of this system is that, when the coupling force is removed (for cleaning and drying), the visco-elastic element expands under the influence of the internal spring, thus pushing the second bearing apart. When the system is provided with the coupling force again (in that the shaving head holder 2 is placed back on the housing 1), the cutting edges will make contact with one another again (in contrast to FIG. 3). This system will always be capable of shaving, albeit sometimes with an increased torque (for example after cleaning). The force $F_1$ will now press the bearing surfaces 14 and 17 onto one another again (preferably in approximately 10 seconds).

FIG. 5 shows a practical realization of a cutting unit as shown in FIG. 4. The internal cutting member 6 is formed by a central portion 18 with the cutting elements 7 at its circumference. The central portion 18 is fastened on an annular plate 19. A bearing bush 20 is fastened in the opening of the annular plate 19. This bearing bush at the same time serves as a coupling bush for coupling to the drive member 11. The internal cutting member 6 is driven by the drive member 11 in this manner. The external cutting member 4 is provided with a central recess 21 whose lower surface forms the bearing surface 14 for cooperation with the bearing surface 17 of the backing plate 16. The bearing bush 20 is radially supported around the central recess 21 of the external cutting member 4.

Materials having visco-elastic properties are, for example, polyborosiloxanes and bitumen.

The invention claimed is:

1. A shaving apparatus with a housing and at least one cutting unit, the apparatus comprising:

an external cutting member having a first central bearing surface;

an internal cutting member drivable into rotation with respect to the external cutting member, the internal cutting member being provided with cutting elements having first cutting edges, the external cutting member being provided with hair trap openings bounded by second cutting edges for cooperating with the first cutting edges of the cutting elements for the purpose of cutting hairs, the cooperating first and second cutting edges forming first bearing surfaces between the external and the internal cutting member;

a drive member for driving the internal cutting member into rotation; and a support device having visco-elastic properties present between second bearing surfaces for reducing a frictional force between the first bearing surfaces over a time period for cutting hair and is restored after the cutting of hairs ceases, wherein at least one of the second bearing surfaces is the first central bearing surface of the external cutting member.

2. The shaving apparatus as claimed in claim 1, further comprising a rim of cutting elements drivable into rotation by the drive member that is resilient in an axial direction and that bears on the internal cutting member in the axial direction, wherein the support device is formed by a visco-elastic element that is centrally fastened on the internal cutting member and is provided with a third bearing surface that bears in the axial direction on at least one second bearing surface formed on the external cutting member.

3. The shaving apparatus as claimed in claim 1, wherein the internal cutting member is drivable into rotation by the drive member, and further comprising a backing plate having a second central bearing surface at its center, the backing plate is connected to the internal cutting member by a visco-elastic element, wherein the visco-elastic properties of the support device are provided by the visco-elastic element, the second bearing surfaces are formed by the second central bearing surface of the backing plate and first central bearing surface of the external cutting member.

4. The shaving apparatus as claimed in claim 3, wherein the drive member is resilient in an axial direction for exerting a force on the backing plate in the direction of the external cutting member.

5. A cutting unit comprising:

an external cutting member having a first central bearing surface;

an internal cutting member drivable into rotation with respect to the former, the internal cutting member being provided with cutting elements having first cutting edges, the external cutting member being provided with hair trap openings bounded by second cutting edges for cooperating with the first cutting edges of the cutting elements for the purpose of cutting hairs;

a first bearing, the cooperating first and second cutting edges forming bearing surfaces of the first bearing between the external and the internal cutting member; and a support device with visco-elastic properties, present between second bearing surfaces for reducing a frictional force between the first bearing surfaces over a time period for cutting hair and is restored after the cutting of hairs ceases, wherein at least one of the second bearing surfaces is the first central bearing surface of the external cutting member.

6. The cutting unit as claimed in claim 5, further comprising a rim of cutting elements drivable into rotation by a drive member that is resilient in an axial direction and that bears on the internal cutting member in the axial direction, and wherein the support device with visco-elastic properties is formed by a visco-elastic element that is centrally fastened on the internal cutting member and is provided with a bearing surface that bears in the axial direction on at least one second bearing surface formed on the external cutting member.

7. The cutting unit as claimed in claim 5, further comprising a rim of cutting elements drivable into rotation by a drive member, and wherein the internal cutting member is provided with a backing plate which is connected to the internal cutting member by means of a visco-elastic element having the visco-elastic properties, while the second bearing surfaces are formed by at least one second bearing surface of the backing plate and at least one second bearing surface of the external cutting member.

* * * * *